US010753000B2

(12) United States Patent
Reinhard et al.

(10) Patent No.: US 10,753,000 B2
(45) Date of Patent: Aug. 25, 2020

(54) COMPOSITIONS OF VAPOR PHASE CORROSION INHIBITORS AND THEIR USE AS WELL AS METHODS FOR THEIR MANUFACTURE

(71) Applicant: EXCOR KORROSIONSFORSCHUNG GmbH, Dresden (DE)

(72) Inventors: Georg Reinhard, Dresden (DE); Peter Neitzel, Dresden (DE); Frank Fassbender, Dresden (DE); Gerhard Hahn, Hann. Muenden (DE)

(73) Assignee: EXCOR KORROSIONSFORSCHUNG GmbH, Dresden (DE)

( * ) Notice: Subject to any disclaimer, the term of this patent is extended or adjusted under 35 U.S.C. 154(b) by 0 days.

(21) Appl. No.: 16/143,603

(22) Filed: Sep. 27, 2018

(65) Prior Publication Data

US 2019/0093236 A1 Mar. 28, 2019

(30) Foreign Application Priority Data

Sep. 27, 2017 (DE) ..... 10 2017 122 483

(51) Int. Cl.
*C23F 11/02* (2006.01)
*C23F 11/14* (2006.01)
*C23F 11/12* (2006.01)

(52) U.S. Cl.
CPC ..... *C23F 11/02* (2013.01); *C23F 11/122* (2013.01); *C23F 11/145* (2013.01); *C23F 11/149* (2013.01)

(58) Field of Classification Search
None
See application file for complete search history.

(56) References Cited

U.S. PATENT DOCUMENTS

| | | | | |
|---|---|---|---|---|
| 393,457 | A | 11/1888 | Beane | |
| 919,778 | A | 4/1909 | Scanlan | |
| 1,224,500 | A | 5/1917 | Pietzsch | |
| 3,398,095 | A | 8/1968 | Judd | |
| 3,785,975 | A | 1/1974 | Humphrey et al. | |
| 3,836,077 | A | 9/1974 | Skildum | |
| 3,967,926 | A | 7/1976 | Rozenfeld et al. | |
| 4,124,549 | A | 11/1978 | Hashiudo et al. | |
| 4,275,835 | A | 6/1981 | Miksic et al. | |
| 4,290,912 | A | 9/1981 | Boerwinkle et al. | |
| 4,374,174 | A | 2/1983 | Stricklin et al. | |
| 4,973,448 | A | 11/1990 | Carlson et al. | |
| 5,137,700 | A | 8/1992 | Sloan | |
| 5,209,869 | A | 5/1993 | Miksic et al. | |
| 5,332,525 | A | 7/1994 | Miksic et al. | |
| 5,393,457 | A | 2/1995 | Miksic et al. | |
| 5,681,506 | A | 10/1997 | Pragnell et al. | |
| 5,840,381 | A * | 11/1998 | Ohtsuka | B32B 27/08 428/34.4 |
| 5,958,115 | A * | 9/1999 | Bottcher | C23F 11/02 106/14.05 |
| 6,054,512 | A | 4/2000 | Nelson et al. | |
| 6,464,899 | B1 | 10/2002 | Haas et al. | |
| 6,540,959 | B1 * | 4/2003 | Reinhard | C23F 11/02 252/390 |
| 6,752,934 | B2 * | 6/2004 | Reinhard | C23F 11/02 252/389.61 |
| 6,787,065 | B1 | 9/2004 | Schapira et al. | |
| 7,014,694 | B1 | 3/2006 | Miksic et al. | |
| 7,763,213 | B2 | 7/2010 | Miksic et al. | |
| 7,824,482 | B2 | 11/2010 | Reinhard et al. | |
| 8,283,024 | B2 * | 10/2012 | Kubik | B32B 25/14 428/213 |
| 8,603,603 | B2 | 12/2013 | Meyer et al. | |
| 8,881,904 | B2 | 11/2014 | Amy | |

(Continued)

FOREIGN PATENT DOCUMENTS

| | | |
|---|---|---|
| EP | 0639657 A1 | 2/1995 |
| EP | 0990676 B1 | 4/2000 |

(Continued)

OTHER PUBLICATIONS

English abstract for RU2604164 (2016).

(Continued)

*Primary Examiner* — Joseph D Anthony
(74) *Attorney, Agent, or Firm* — Caesar Rivise, PC

(57) ABSTRACT

The invention relates to corrosion-inhibiting substance combinations capable of evaporation or sublimation, containing at least: (1) substituted 1,4-benzoquinone, (2) aromatic or alicyclic substituted carbamate, (3) polysubstituted phenol, and (4) monosubstituted pyrimidine. These combinations preferably include 1-30 mass % of component (1), 5-40 mass % of component (2), 2-20 mass % of component (3), and 0.5-10 mass % of component (4), each relating to the total quantity of the substance combination. The components can be provided mixed together or dispersed in water, or also pre-mixed in solubilizer that can be mixed with mineral oils and synthetic oils, preferably an arylalkylether alcohol such as, e.g., phenoxyethanol. Such substance combinations can be used as vapor phase corrosion inhibitors in packaging or during storage in closed spaces for protecting common commodity metals such as iron, chrome, nickel, aluminum, copper and their alloys as well as galvanized steels, against atmospheric corrosion.

14 Claims, No Drawings

(56) References Cited

U.S. PATENT DOCUMENTS

| | | | | |
|---|---|---|---|---|
| 8,906,267 | B2 * | 12/2014 | Reinhard | C23F 11/02 252/387 |
| 9,435,037 | B2 | 9/2016 | Kharshan et al. | |
| 9,518,328 | B1 | 12/2016 | Whited et al. | |
| 2003/0031583 | A1 * | 2/2003 | Reinhard | C23F 11/02 422/10 |
| 2003/0142438 | A1 * | 7/2003 | Brown | G11B 17/028 360/97.16 |
| 2004/0021980 | A1 * | 2/2004 | Albrecht | G11B 5/6005 360/99.21 |
| 2005/0019537 | A1 * | 1/2005 | Nakaishi | B65D 75/006 428/218 |
| 2012/0141642 | A1 * | 6/2012 | Kubik | B32B 7/12 426/133 |
| 2012/0141754 | A1 * | 6/2012 | Kubik | B32B 25/14 428/213 |
| 2015/0018461 | A1 | 1/2015 | Todt et al. | |

FOREIGN PATENT DOCUMENTS

| | | | |
|---|---|---|---|
| EP | 1218567 | B1 | 7/2002 |
| EP | 1219727 | A2 | 7/2002 |
| EP | 2347897 | A1 | 7/2011 |
| EP | 2730696 | A1 | 5/2014 |
| EP | 2752290 | A1 | 7/2014 |
| EP | 1641960 | B1 | 9/2014 |
| JP | 61227188 | A | 10/1986 |
| JP | 62063686 | A | 3/1987 |
| JP | 63028888 | A | 2/1988 |
| JP | 63183182 | A | 7/1988 |
| JP | 63210285 | A | 8/1988 |
| JP | 07145490 | A | 6/1995 |
| JP | 4124549 | B2 | 7/2008 |
| JP | 2016117920 | A | 6/2016 |
| KR | 1020160011874 | A | 2/2016 |
| RU | 2299270 | C1 | 5/2007 |
| RU | 2604164 | C1 | 12/2016 |
| WO | 0029641 | A | 5/2000 |
| WO | 2004108991 | A1 | 12/2004 |
| WO | 2016022406 | A1 | 2/2016 |

OTHER PUBLICATIONS

English abstract for RU2299270 (2007).
English Abstract for EP 2347897 A1 (2011).
English Abstract for EP 2730696 A1 (2014).
English Abstract for EP 2752290 A1 (2014).
English Abstract for JP 07145490 A (1995).
English Abstract for JP 4124549 B2 (2008).
English Abstract for JP 61227188 A (1986).
English Abstract for JP 63028888 A (1988).
English Abstract for JP 63183182 A (1988).
English Abstract for JP 63210285 A (1988).
English Abstract for JP 2016117920 A (2016).
Nhlapo. (2013). TGA-FTIR study of the vapours released by volatile corrosion inhibitor model systems. University of Pretoria, 1-118.
Reinhard, Korrosionsschutz durch zusaetze zum einwirkenden medium, in Korrosion und Korrosionsschutz (E. Kunze ed. 2001). Chapter 4.1, 1679-1714.
Vuorinen et al. (2004). Introduction to vapour phase corrosion inhibitors in metal packaging. Surface Engineering, 20(4), 281-284.
Wuestenberg, Temporaerer korrosionsschutz von halbzeugen, Bauteilen und Anlagen, in Korrosion und Korrosionsschutz (E. Kunze ed. 2001). Chapter 4.2, 1715-1756.

* cited by examiner

COMPOSITIONS OF VAPOR PHASE CORROSION INHIBITORS AND THEIR USE AS WELL AS METHODS FOR THEIR MANUFACTURE

BACKGROUND OF THE INVENTION

The present invention relates to substance combinations as vapor phase corrosion inhibitors (corrosion inhibitors with evaporation or sublimation capacity, vapor phase corrosion inhibitors VpCI, volatile corrosion inhibitors, VCI) and methods for their application for the protection of common commodity metals such as iron, chrome, nickel, aluminum, copper and their alloys as well as galvanized steels against corrosion in moist air climates.

Compounds which had been identified as corrosion inhibitors and which also tend towards evaporation or sublimation under normal conditions and therefore can reach the metal surfaces to be protected via the gaseous phase have been used for several decades for the temporary corrosion protection of metal objects within enclosed spaces, for example in packaging, control cabinets or display cabinets. The protection of metal components against corrosion during storage and transport in this way is the clean alternative to temporary corrosion protection with oils, fats or waxes.

All temporary metal corrosion protection measures against the effect of air-saturated aqueous media or condensed water films are known to be aimed at conserving the primary oxide layer (primary oxide layer, POL) always present on commodity metals following their first contact with the atmosphere against chemical and mechanical degradation (compare for example: E. Kunze (publisher), Corrosion and Corrosion Protection, Volume 3, Wiley-VCH, Berlin, N.Y. 2001, p. 1679-1756). In order to achieve this by the application of corrosion inhibitors preferably acting via the gaseous phase, it should however be taken into account that common commodity metals and the POL always present on their surfaces have different chemical characteristics. Vapor phase corrosion inhibitors must therefore be selected depending on the type of metal to be protected in principle (compare for example: U.S. Pat. Nos. 4,374,174, 6,464,899, 6,752,934 B2, 7,824,482 B2 and 8,906,267 B2).

For objects and constructions made from different metals and possibly also existing in different processing conditions (rough, smoothed, polished etc.), combinations of different corrosion inhibitors are consequently also required in order to guarantee respective reliable temporary corrosion protection for the metals and surface conditions in question within one and the same container or a common packaging. As such mixed metal objects and components are technically the most prevalent today from our experience, the determination of suitable substance combinations of corrosion inhibitors acting via the gaseous phase is of ever increasing importance.

The use of such combinations of volatile corrosion inhibitors (VpCI/VCI) in practice should be possible in particular in view of already established applications, although adapted to the various sensibilities of the metals and surface conditions to be protected in air with various humidity and compositions as well as with regard to the compatibility of individual components amongst each other.

In order to realize reliable corrosion protection for metal components inside containers and packaging, the walls of which are permeable for water vapor-containing air (paper, plastic film and others) by means of VpCI/VCI it must be guaranteed that the active substances are as a rule released sufficiently quickly from the respective depository through evaporation and/or sublimation, through diffusion and convection within the closed packaging reach the metal surfaces to be protected and form an adsorption film there before water can condense from moist air in the same place.

The time known as a so-called development phase (conditioning or incubation time), during which the conditions for VCI corrosion protection are established after closing the container/the packaging, can naturally not be too long for above averagely corrosion susceptible metal surfaces, as the corrosion process will otherwise have started before the VCI molecules reach the vicinity of the metal surface.

Depending on the type of metal to be protected and the existing surface conditions one must therefore not only use a suitable combination of VpCI/VCI components, but must also apply these in such a way that the so-called development phase required for developing their effect is adapted to fulfil the respective requirements.

Solids that tend towards sublimation even under normal conditions are known to adjust their evaporation equilibrium with the gaseous phase increasingly easily as their specific surface increases. The provision of such corrosion inhibitors in powder form with the smallest possible particle size can thus be considered a basic requirement for the setting of the shortest possible development phase. VpCI/VCI in the form of finely dispersed powders, packed in pouches made of a material that is permeable for the vaporous active substances (for example paper bags, porous polymer film, perforated capsules) have therefore long been in commercial use. To expose them within closed packaging in addition to the metal components to be protected is the simplest form of a practical application of VpCI/VCI (compare for example: E. Vuorinen, E. Kalman, W. Focke, Introduction to vapor phase corrosion inhibitors in metal packaging, Surface Engng. 29(2004) 281 pp., U.S. Pat. Nos. 4,973,448, 5,393,457, 6,752,934 B2, 8,906,267 B2, 9,435,037 and EP 1 219 727 A2). The development phases that can be realized with the same can also be regulated with the permeability of the walls of such depots. If mixtures of different substances are to be used instead of individual corrosion inhibitors it must additionally be guaranteed that they neither chemically react with each other nor lead to a formation of agglomerates, as this would prevent their emission from the depot as well as their required chemisorptions on the metal surfaces to be protected, or would at least strongly affect the same.

In modern packaging materials for temporary corrosion protection the VpCI/VCIs are normally already integrated these days, so that their technical application is simple and can also be automated. Paper, cardboard, foam or textile fleece materials with a VCI containing coatings are common here as well as polymer substrate materials into which the active VCI substances in question are integrated so that their emission from the same remains possible. Different variants are for example suggested in U.S. Pat. Nos. 3,836,077, 3,967,926, 4,124,549, 4,290,912, 5,209,869, 5,332,525, 5,393,457, 6,752,934 B2, 7,824,482, 8,906,267 B2, JP 4.124.549, EP 0.639.657 and EP 1.219.727, always with the aim of inserting the VpCI/VCIs into a depot, such as for example into capsules, coatings or gas permeable plastic films respectively in such a way that a product from which the VCI components can continuously evaporate or sublimate results. To achieve this with combinations of several substances and also to initiate a physically approximately equivalent behavior with regard to migration inside the depot and emission from the same for every component, is however complicated by nature and clearly explains why optimal VCI corrosion protection characteristics are realized only rarely for many applications with the substance combinations known to date, namely for mixed metal objects and components. Different particle sizes of the components of a substance combination can already cause defects in an individual case if the structure-dependent pores of the walls of the active substance depot are for example not big enough to guarantee identical conditions with regard to permeation and sublimation of individual molecules or molecule associates of the active substance mixture.

From experience the integration of VpCI/VCIs into a coating agent allows a relatively easy manufacture of coatings for flat packaging materials (paper, cardboard, foam, textile fleece material etc.) these days, from which the respective VpCI/VCIs can be released at emission rates that guarantee comparatively short development phases for VCI corrosion protection. This requires the selection of a suitable coating agent that finely disperses the substance combination integrated in powder form in the first instance and absorbs the same to a sufficiently high filling degree, and cross-links on the respective substrate into a well adhering, porous layer from which the respective VpCI/VCIs can then once again sublimate without much resistance. The application quantity of VpCI/VCI coating agent also offers the possibility of adapting the VpCI/VCI depot to the conditions of the shortest possible development phases.

Manufacturing VpCI/VCI containing packaging material in that the active substances are dispersed in a suitable coating agent and applied to a flat substrate material has therefore been practiced for a long time. Methods of this type with various active substances and coating agents are for example described in JP 61.227.188, JP 62.063.686, JP 63.028.888, JP 63.183.182, JP 63.210.285, U.S. Pat. Nos. 5,958,115, 8,906,267 B2 and 9,518,328 B1.

The integration of VpCI/VCIs in polymer substrate materials, preferably in polyolefins (PO) such as polyethylene (PE) and polypropylene (PP), and the provision of VpCI/VCI-emitting films and further PO products (granulates, trays, etc.), for example as suggested in U.S. Pat. Nos. 4,124,549, 4,290,912, 5,139,700, 6,464,899 B1, 6,752,934 B2, 6,787,065 B1, 7,824,482, EP 1 218 567 A1 and EP 1 641 960 B1, is known to be practiced to a particularly high extent these days, for the reason alone that these products can be advantageously applied for an automation of packaging processes.

These polymer-based VpCI/VCI products do however normally have the disadvantage that the VpCI/VCIs incorporated during extrusion via the polymer melt are present in a powder form or relatively firmly enclosed in coatings in the polymer matrix, unlike the VpCI/VCI deposits described above, and their emission from the same is thus possible only with comparative difficulty. In the VpCI/VCI films normally used with layer thicknesses d within a range of 60 μm≤150 μm today it is also not possible to use the high specific active substance concentrations that can for example be accommodated in VpCI/VCI coatings. In addition losses of VpCI/VCI components that are difficult to control normally occur during the extrusion of the respective master batches and films due to the thermal load that occurs. Experience shows that none of the currently known VpCI/VCI substrate combinations can provide films suitable for the VCI corrosion protection of above averagely corrosion sensitive metal surfaces, for the simple reason that it has not been possible for the said reasons to set the necessary, relatively short development phases. VpCI/VCI films commercially available today have therefore primarily been used as technologically easy-to-apply mass articles to date without being able to satisfy higher requirements regarding their VCI corrosion protection characteristics.

A number of suggestions have become known for improving this situation and to profile packaging with polymer films to be more effective with regard to incorporated VpCI/VCI systems. All measures that enable the emission of VpCI/VCI components integrated into polymer films in just one direction appear expedient here, oriented on the metal component to be protected in the packaging, and for equipping the opposite side as a barrier.

It is for example suggested in U.S. Pat. Nos. 5,393,457 A1, 7,763,213 B2 and 8,881,904 B2 to encase the packaging primarily manufactured with film containing VpCI/VCI wrapped around the metal component to be protected with an additional barrier film. U.S. Pat. No. 5,137,700 however envisages that the outside of the VpCI/VCI film is laminated with a metal or plastic layer acting as a barrier prior to use as a packaging material and to stipulate the film equipped with the VpCI/VCI component as the inside when packing the metal component to be protected. The suggestion according to U.S. Pat. No. 8,881,904 B2 of manufacturing the VpCI/VCI film in a multi-layered way through co-extrusion from the start and to not dose the layer positioned as the outside with a VpCI/VCI master batch will from our experience not lead to this outer layer of the film then functioning as a barrier against the permeation of the vaporous VpCI/VCI components. Instead the emission of VpCI/VCI components from the internal layer into the gas space of the packaging will normally be worse, because the degradation of the concentration gradient required for this already commences through migration of the active substances into the initially active substance-free outer layer during storage of the co-extrusion film on a roll and will result in a lessening of the VCI effect.

As one has been unable to date to achieve an acceleration of the emission of the VpCI/VCI components in question into the interior of the closed packaging by using an additional barrier film or by equipping the outside of a VpCI/VCI containing film as a diffusion barrier, further measures have been suggested for shortening the so-called development phase of the respective integrated VpCI/VCI system in film packaging in such a way that improved VCI corrosion protection characteristics result. One step in this direction is for example the coating of the inside of a polymer film with a gel containing the VpCI/VCI components, fixed under a gas permeable inner film made of Tyvek® 1059 (DuPont) (compare U.S. Pat. No. 7,763,213 B2), which supposedly also makes it possible to stipulate much higher quantity proportions of the VpCI/VCI components than is possible with direct integration into a polymer film by means of extrusion.

A further, somewhat equivalent way consists of the introduction of individual or several VpCI/VCI components into a suitable adhesive in order to then coat the inside of polymer films with the same as required (compare for example: EP 2 347 897 A1, EP 2 730 696 A1, EP 2 752 290 A1 and US 2015/0018461 A1). If an adhesive that is compatible with the introduced VpCI/VCI components has been selected and cures as a porous layer, one will indeed realize higher emission rates for these components than for those that would result from films into which the VpCI/VCI components were integrated during extrusion.

And finally the suggestions of interspersing a VpCI/VCI system directly in the film serving as packaging material as a finely dispersed powder (compare for example: U.S. Pat. No. 8,603,603), to place it near the metal components to be protected in the form of high-filled briquettes (so-called premix, compare U.S. Pat. No. 6,787,065 B1), or of introducing it in the form of fine granulates to a flat porous foam, to the other side of which a thin polymer film has been laminated (compare for example: U.S. Pat. Nos. 5,393,457 and 9,435,037 B2) represent further possibilities of providing a low-resistance subliming VpCI/VCI system with a relatively high quantity proportion inside film packaging.

All of these suggestions have however been too material- and cost-intensive to date, so that in practice one preferably reverts from experience to the application variants of the VpCI/VCI systems already mentioned and considered as classics when designing high-performance corrosion protection packaging.

As we know these also include VpCI/VCI-containing oils, wherein requirements for products suitable for the VCI corrosion protection of components consisting of different metals and in different processing conditions in particular are ever increasing. Such a VpCI/VCI-containing oil is known to have not only to protect the metal substrate in question, onto which it is applied as a thin film, but also surface areas of the same component or neighboring metal objects that cannot be coated with an oil film due to their geometry (for example bores, narrow grooves, folded sheet metal layers) against corrosion. As with the VpCI/VCI depot already mentioned it is once again necessary that the VpCI/VCI components now emitted from the oil, as the carrier material, reach the surface areas of metal components not covered with the oil inside closed spaces (for example packaging, containers, hollow spaces) via the vapor phase, and form a corrosion protective adsorption film there.

VpCI/VCI oils are for example described in patent documents U.S. Pat. Nos. 919,778, 3,398,095, 3,785,975, 8,906,267, 1,224,500 and JP 07145490 A. As these VpCI/VCI oils emit volatile corrosion inhibitors and also protect areas of metal surfaces not covered by an oil against corrosion via the gaseous phase, they clearly differ from conservation oils, the corrosion protection characteristics of which are improved through introduction of non-volatile corrosion inhibitors that are effective only upon direct contact. Such corrosion protection oils are for example described in patent documents U.S. Pat. Nos. 5,681,506, 7,014,694 B1 and WO 2016/022406 A1.

Most of the currently known VpCI/VCI oils have however been profiled only for the VCI corrosion protection of ferrous materials. They normally contain higher quantity proportions of one or more amines, so that a relatively high concentration gradient can become effective inside closed packaging for their migration within the oil phase and their emission from the same to atmosphere. The development phase required for developing its VCI effect is then also correspondingly short. The amine reaching the metal surface to be protected via the gaseous phase ensures an alkaline surface pH value in the water condensed from moist air there, at which the POL of conventional ferrous materials is consistent (see for example: Kunze (publisher) loc. cit.). From experience these amine-based VpCI/VCI oils are however not suitable for the VCI corrosion protection of non-ferrous metals (for example Al and Cu base materials) and galvanized steel, as their POL will degrade at these high surface pH values whilst forming hydroxo complexes, followed by corrosion.

It has been common practice for many years to use amines that already have a vapor or sublimation pressure under normal conditions as VCI/VpCIs, and this has been described in numerous patents (compare for example: E. Vuorinen, et al., loc.cit. and U.S. Pat. No. 8,906,267 B2). Today one preferably limits this to the cyclic amines dicyclohexylamine and cyclohexylamine (compare for example: U.S. Pat. Nos. 4,275,835, 5,393,457, 6,054,512, 6,464,899 B1, 9,435,037 and 9,518,328 B1) as well as the various primary and tertiary alkanolamines such as 2-aminoethanol and triethanolamine, or corresponding substitutes (compare for example: E. Vuorinen, et al., loc.cit. as well as U.S. Pat. Nos. 6,752,934 B2 and 8,906,267 B2).

Secondary amines such as diethanolamine, morpholine, piperidine and many others previously recommended for preferred use, are however rarely considered for technical use now that it has become known that these are easily nitrosated into carcinogenic N-nitrosamines even in air under normal conditions.

As the cyclic amines and amino alcohols are liquid under normal conditions, they must first be transferred into a solid condition by forming salts for the above-mentioned applications (for example for powder-containing emitters or the introduction into polymer carrier materials). The respective amine carbonates, nitrites, nitrates, molybdates and carboxylates, and of the latter primarily the amine benzoates and caprylates, are the most common VCI/VpCIs used for the corrosion protection of ferrous materials today (compare for example: EP 0 990 676 B1, U.S. Pat. Nos. 4,124,549, 5,137,700, 393,457, 6,464,899 A1, 8,603,603 B2, 9,435,037, 9,518,328 B2 and JP 2016-117920 A).

With the amine carboxylates the amine compounds as well as the associated carboxylic acid in particular are volatile and therefore both reach the metal surfaces to be protected via the vapor phase. The surface pH value generated there in the presence of water vapor will then normally lie within the neutral range, which mostly influences the corrosion protection effect for non-ferrous metals in a positive way. Amines alone however will lead to higher surface pH values within the alkaline range and will, as already mentioned, lead to corrosion phenomena primarily with aluminum base materials and galvanized steels.

As amines normally already have higher vapor pressures under normal conditions than the associated carboxylic acids we know from experience that the preferred enrichment of the amine components will take place over time, primarily with films into which amine carboxylates were introduced as VCI/VpCIs. This does however of necessity also result in films of this kind that have been used for some time or stored mainly emitting only the remaining carboxylic acid. However, if only carboxylic acids reach the metal surfaces to be protected via the vapor phase then low acidic surface pH values will occur there in the presence of moist air. This prevents an adsorption of the carboxylate species on the POL of the metal surface to be protected and therefore counteracts corrosion inhibition (compare for example: N. S. Nhlapo, thesis "TGA-FTIR study of vapors released by volatile corrosion inhibitor model systems", Fac. Chem. Engng., Univ. of Pretoria, S.A., July 2013). A formation of visible corrosion products will however initially not occur with ferrous material in particular because its POL is known to be converted into a thin iron carboxylate cover layer that is not perceivable without modern optical methods. As such thin salt-like conversion layers are however porous, corrosion of the iron-based material present in the pores will in the end result with continued exposure in moist air accompanied by hydrogen generation with a formation of visible corrosion products, as is the case practically straight away with Al materials and galvanized steels under the influence of acidic aqueous media. From current experience VCI/VpCI preparations with amine carboxylates are therefore suitable at most for the relatively short-term corrosion protection of ferrous materials, and are not suitable for protecting mixed metal components.

The same applies for the application of nitrites acting as passivators. With these salts of nitrous acid it is possible to achieve a spontaneous reproduction of the POLs of ferrous materials if these have been destroyed through partial chemical dissolving or localized mechanical abrasion (abrasion, erosion) (compare for example: E. Vuorinen, et al., loc. cit. and U.S. Pat. No. 6,752,934 B2). They have therefore been used as VCI/VpCIs for some time. The relatively readily volatile salt dicyclohexyl ammonium nitrite (DICHAN) in particular has been used as a VCI for the protection of ferrous materials for more than 70 years (compare for example Vuorinen et al., loc. cit.). This DICHAN has been mentioned as a component of VCI/VpCI compositions in numerous patent documents up until recent times (for example: U.S. Pat. Nos. 5,393,457, 6,054,512, 6,752,934 B2, 9,435,037, JP 2016-117920 A and EP 0 990 676 B1), although only ever for the VCI corrosion protection of ferrous materials. All known recipes containing the DICHAN, in most cases supplemented with further components such as water-free molybdates, carboxylates, benzotriazole or tolyltriazole (compare for example: U.S. Pat. Nos. 5,137,700, 5,393,457 and 6,054,512) have so far proven themselves as unsuitable for the protection of mixed metal components with aluminum and copper materials as well as for galvanized steels for various reasons.

With the aim of creating VpCI/VCI packaging materials that can be used not only for the protection of ferrous materials, but at least also for galvanized steels and aluminum materials, various amine-free VpCI/VCIs systems where a nitrous acid salt (ammonium or alkali nitrite) with further sublimation-capable substances, such as for example various saturated or unsaturated carboxylic acids or their alkaline salts, a polysubstituted phenol and/or an aliphatic ester of a hydroxybenzoic acid are combined, have been suggested (compare for example: U.S. Pat. Nos. 4,290,912, 6,464,899 B1, 6,752,934, 6,787,065 B1, EP 1 641 960 B1 and KR 1020160011874 A).

Other suggestions prefer amine- and nitrite-free substance combinations instead, for example consisting of various saturated or unsaturated carboxylic acids or their alkaline salts in combination with an aliphatic ester of a mono- or dihydroxybenzoic acid, an aromatic amide and, if necessary, completed with benzotriazole or tolyltriazole for the protection of Cu materials (compare for example: U.S. Pat. Nos. 4,124,549, 4,374,174, 7,824,482).

It has been possible, by admixing selected sublimatable, water-insoluble but water vapor-volatile polysubstituted phenols (compare for example: U.S. Pat. Nos. 4,290,912, 6,752,934, 7,824,482, EP 1 641 960 B1), bicyclic terpenes and aliphatic-substituted naphthalenes (compare for example: U.S. Pat. No. 6,752,934), to improve the emission of the VpCI/VCI components contained in the respective substance combination already under normal conditions, in particular in air with a higher relative humidity, and to bring the same to the level common for amines. However, the resulting VCI corrosion protection for ferrous as well as for other common non-ferrous metals containing VpCI/VCI components still requires comparatively high-filled active substance depots, as always higher quantity proportions of the substances acting as carrier must also be accommodated in addition to the respective VpCI/VCI components.

Good corrosion protection could be realized for objects consisting of several metals and surface conditions with VpCI/VCI combinations consisting of an aminoalkyldiol with $C_3$ to $C_5$, a monoalkyl carbamide, a preferably polysubstituted pyrimidine and benzotriazole suggested in U.S. Pat. No. 8,906,267 B2, without admixing substances acting as carriers.

Inorganic and organic salts such as the alkali nitrites, nitrates and carboxylates are in any case unsuitable for the introduction of VpCI/VCI combinations into mineral or synthetic oils in particular, as they are not sufficiently soluble in the same. Such VpCI/VCI oils have therefore in the past been mainly formulated through use of amines as VCI components (compare for example: U.S. Pat. Nos. 919,778, 1,224,500, 3,398,095, 3,785,975 and JP 07145490 A), sometimes supplemented with further volatile additives such as $C_6$ to $C_{12}$ alkyl carboxylic acids and esters of unsaturated fatty acids (compare U.S. Pat. No. 3,398,095). JP 07145490 A however claims preparations with ethanolamine carboxylates, morpholine, cyclohexylamine and various sulphonates. All of these recipes do however have in common that only the amine components are emitted under normal conditions, i.e. at temperatures of <60° C., and become active as VpCI/VCIs.

Such VpCI/VCI oils are therefore suitable only for the VCI corrosion protection of ferrous materials. With zinc and aluminum they are known to normally cause an excessive alkalization of the surfaces together with condensed water, the consequence of which is strong corrosion whilst forming zincates or aluminates, before hydroxides and basic carbonates are finally created, which are commonly known as white rust. Copper materials however often suffer corrosion under the influence of amines whilst forming Cu amine complexes.

To counteract this defect the VpCI/VCI combination of an aminoalkyldiol with $C_3$ to $C_5$, a monoalkyl carbamide, a preferably polysubstituted pyrimidine and benzotriazole suggested in U.S. Pat. No. 8,906,267 B2 can be introduced into a mineral oil or a synthetic oil via a solubilizer in such a way that a VpCI/VCI oil is created, with which good VCI corrosion protection can be provided for a wide range of common commodity metals. It has now been found to be a disadvantage that only relatively small quantity proportions of the VpCI/VCI components can be introduced, so that the very good VCI effect of fresh preparations increasingly deteriorates with long-term applications. The same was found when such a VpCI/VCI oil was diluted with a conventional mineral oil.

New VpCI/VCI systems, the use of which is not connected with the described disadvantages in practice, are therefore required, in particular to satisfy the requirement for oils equipped with VpCI/VCI for managing the temporary corrosion protection of ferrous and non-ferrous metals with construction-related small hollow spaces. Preparations that can be processed to produce not only a VpCI/VCI oil, but at least also VpCI/VCI dispensers (mixtures of particulate VpCI/VCI components in pouches, capsules etc.) and coated VpCI/VCI packaging materials (for example paper, cardboard, foam) are of particular interest here.

Particularly effective VCI corrosion protection packaging characterized by a long service life can be produced by combining such VpCI/VCIs that are compatible with each other in an unlimited way for the said applications, for example as preservation packaging for engine blocks treated with the VpCI/VCI oil in containers closed with a lid, in which VCI-emitting pouches, capsules etc. or VCI-coated paper or foam cuttings are also placed, in order to ensure constant saturation of the gas space of the containers in question with the VpCI/VCI components even during long-time storage as a requirement for the maintenance of VCI corrosion protection.

It is the objective of the invention to provide improved evaporation- or sublimation-capable corrosion-inhibiting substances and substance combinations in view of the above listed disadvantages of conventional volatile corrosion inhibitors acting via the vapor phase, which can be supplied as a powder mixture as well as introduced into coatings and oils under the interesting climate conditions prevailing in practice in technical packaging and similarly in closed containers with sufficient speed from the corresponding depot, for example a pouch containing the VpCI/VCI components, a coating containing the VpCI/VCI components on a carrier such as paper, cardboard or foam, or through evaporating or sublimating from an oil containing the VpCI/VCI components, to ensure conditions on the surface of metal components located in this space following adsorption and/or condensation there under which common commodity metals are reliably protected against atmospheric corrosion.

According to the invention these objectives could be achieved with the provision of the substance combination according to the invention.

DESCRIPTION OF THE INVENTION

The substance combination according to the invention comprises at least the following components:

(1) a substituted 1,4-benzoquinone, (2) an aromatic or alicyclic substituted carbamate, (3) a polysubstituted phenol and (4) a monosubstituted pyrimidine.

Depending on the special area of application the quantity proportions of the various components can vary, and suitable compositions can be easily determined by a person skilled in the art in this field by means of routine trials.

In one preferred embodiment of the invention 1 to 30 mass % of component (1), 5 to 40 mass % of component (2), 2 to 20 mass % of component (3) and 0.5 to 10 mass % of component (4), each relating to the total quantity of the substance combination, are included in the corrosion-inhibiting substance combination.

The substituted 1,4-benzoquinone is here preferably selected from the group comprising tetramethyl-1,4-benzoquinone (duroquinone), trimethyl-1,4-benzoquinone, 2,6-dimethoxy-1,4-benzoquinone (DMBQ), 2,5-dimethoxy-1,4-benzoquinone, 2-methoxy-6-methyl-1,4-benzoquinone, and similarly structured, in particular alkyl- or alkoxy-substituted, substituted 1,4-benzoquinones as well as combinations of the same.

The aromatic or alicyclic substituted carbamate is preferably selected from the group comprising benzyl carbamate, phenyl carbamate, cyclohexyl carbamate, p-tolyl carbamate and similarly structured substituted carbamates as well as combinations of the same.

The polysubstituted phenol is preferably selected from the group comprising 5-methyl-2-(1-methylethyl)phenol (thymol), 2,2'-methylene-bis-(4-methyl-6-tert.-butylphenol), 2-tert.-butyl-4-methylphenol, 2.4.6-tri-tert.-butylphenol, 2.6-dimethoxyphenol (syringol) and similarly structured polysubstituted phenols as well as combinations of the same.

The monosubstituted pyrimidine is preferably selected from the group comprising 2-aminopyrimidine, 4-aminopyrimidine, 2-methylpyrimidine, 4-methylpyrimidine, 5-methoxypyrimidine, 5-ethoxypyrimidine, 4-phenylpyrimidine, 2-phenoxypyrimidine, 4-(N,N-dimethylamino)pyrimidine and similarly structured monosubstituted pyrimidines as well as combinations of the same.

With the corrosion-inhibiting substance combination according to the invention the components (1) to (4) can for example be present mixed with each other or dispersed in water, or also pre-mixed in a solubilizer to be mixed with mineral oils and synthetic oils.

This solubilizer is preferably an arylalkylether alcohol, such as for example phenoxyethanol (protectol PE), commonly used for oil preparations, in which the components are present dissolved or dispersed.

The corrosion-inhibiting substance combinations according to the invention can also contain, in addition to components (1) to (4) according to the invention and possibly the solubilizer, substances already introduced as vapor phase corrosion inhibitors, either individually or as a mixture of the same.

The composition of the corrosion-inhibiting substance combinations according to the invention is preferably adjusted in such a way that all components evaporate or sublimate at a quantity and speed that is adequate for vapor room corrosion protection within a temperature range of +80° C., typically within a range of 10° C. to 80° C., at a relative humidity (RH) of ≤98%.

According to the invention these substance combinations are used directly in the form of corresponding mixtures or introduced according to methods known in themselves during the manufacture of VpCI/VCI packaging materials and oil preparations, so that these packaging materials or oils will act as a VCI depot and the corrosion protection characteristics of the substance combinations according to the invention can develop in a particularly advantageous way.

In one embodiment the corrosion-inhibiting substance combinations are used as a volatile corrosion inhibitor (VPCI, VCI) in the form of fine powder mixtures or briquettes (pellets) manufactured from the same during the packaging, storage or the transport of metal materials.

The corrosion-inhibiting substance combinations can however also be incorporated into coating materials or coating solutions, preferably in an aqueous/organic medium, and/or colloidal composite materials in order to coat carrier materials such as paper, cardboard, foam, textile fabric, textile fleece and similar flat fabrics as part of manufacturing VCI-emitting packaging materials, and to then use the same during packaging, storage and transport processes.

In another embodiment the corrosion-inhibiting substance combinations are used for manufacturing VCI corrosion protection oil, from which vapor phase corrosion inhibitors are emitted (VPCI, VCI).

Such VCI corrosion protection oil preferably comprises a mineral oil or synthetic oil and 0.5 to 5 mass %, more preferably 0.8 to 3 mass %, related to the oil phase, of a corrosion-inhibiting substance combination according to the invention, optionally in a solubilizer, and the composition is adjusted in such a way that all corrosion inhibitor components evaporate or sublimate at a sufficient quantity and speed for vapor room corrosion protection from the VCI oil within a temperature range of up to 80° C., typically within a range of 10° C. to 80° C., at relative humidity of (RH) ≤98%.

The substance combinations according to the invention are primarily used to protect a wide range of common commodity metals, in particular iron, chrome, nickel, aluminum, copper and their alloys as well as galvanized steels, in packaging and during storage in analogue closed spaces against atmospheric corrosion.

The substance combinations according to the invention are nitrite- and amine-free and advantageously consist only of substances that are easy to process without risk with methods known in themselves, and which can be classed as non-toxic and not environmentally harmful in the quantity proportions to be used. They are therefore particularly suitable for manufacturing corrosion protection packaging material that can be used on a large scale in a cost-effective way without an appreciable risk potential.

It is normally expedient for the introduction of the substance combinations according to the invention into VpCI/VCI depots or into packaging material and oils functioning as such to mix individual substances with each other first under water-free conditions, using methods known in themselves, as intensely as possible.

The substance combinations according to the invention are preferably formulated within the following mass proportions:

Component (1): 1 to 30%
Component (2): 5 to 40%
Component (3): 2 to 20%
Component (4): 0.5 to 10%.

The subject of the application is explained in more detail with reference to the following examples. As also evident therefrom the type, quantity proportion of individual components in the mixture according to the invention, and the quantity proportion of the mixture in the respective VpCI/VCI depot will depend only on the manufacturing conditions of the VpCI/VCI-emitting product and the processing excipients required for this, and not on the type of the metal to be protected against corrosion.

Example 1

The following preparation VCI (1) according to the invention was manufactured with the water-free components of the substance combination according to the invention and water-free substances serving as processing excipients:

| | |
|---|---|
| 10.0 mass % | tetramethyl-1,4-benzoquinone (duroquinone) |
| 8.0 mass % | benzyl carbamate |
| 6.0 mass % | 5-methyl-2-(1-methylethyl)-phenol (thymol), |
| 6.0 mass % | 5-ethoxypyrimidine, |
| 20.0 mass % | silica gel ($SiO_2$) |
| 10.0 mass % | sodium benzoate, (micronized, $d_{95} \leq 10$ μm) |
| 8.0 mass % | 1-H benzotriazole |
| 1.0 mass % | 2-(2H-benzotriazole-2-yl)-p-cresole (tinuvin P, CIBA) |
| 30.0 mass % | non-polar PE wax (CWF 201, ALROKO) |
| 1.0 mass % | calcium stearate ($d_{95} \leq 8$ μm) |

0.5 g each of this carefully homogenised powder mixture was filled into a previously produced small pouch made of Tyvek 1057 D (54 g/m$^2$), a vapor-permeable synthetic film, the opening of which was welded shut, and this pouch was then placed on a floor insert made of PMMA equipped with holes, which served as a base surface of the preserving jar used to receive the test arrangement (volume 1 l) to guarantee a distance of approx. 15 mm. 15 ml of deionized water had previously been dosed under this floor insert. A bar made of PMMA equipped with approx. 5 mm deep notches was positioned in the floor insert next to the filled Tyvek pouch. 4 pieces of carefully cleaned metal test sheets (90×50×d) mm, each of a different type, were placed upright with approx. 15° inclination from the vertical at a distance of 10 mm from each other. Per preserving jar this was each 1 metal test sheet made of DC 03 steel, cold-rolled, low-carbon, material no. 1.0347, d=0.5 mm, aluminum 99.5, d=0.625 mm (both Q-Panel Cleveland), Cu ETP (MKM Mansfelder Kupfer and Messing GmbH), d=0.5 mm and hot-dip galvanized DX56D+Z140MBO steel (fine grain zinc coating 140 g/m$^2$-70/70 g/m$^2$-10 μm, ArcelorMittal), d=0.8 mm, respectively.

The preserving jars with the metal test sheets, the deionized water and the substance combination according to the invention were closed tightly, for which a lid with a sealing ring each as well as three tensioning clamps were used. After a waiting time of 16 h at room temperature the so-called development phase of the VCI components could be considered complete inside the vessel. The individual preserving jars were then exposed in a heat cabinet according to DIN 50011-12 at 40° for 16 h, then cooled back to room temperature for 8 h. This cyclic load (1 cycle=24 h) was briefly interrupted after every 7 cycles respectively, the preserving jars opened for approx. 2 minutes to replace atmospheric oxygen that may have permutated and to inspect the surface conditions of the metal sheets. After a total of 35 cycles the exposure was terminated and each test piece visually evaluated outside the preserving jars in detail.

With reference to substance mixture VCI (1) according to the invention 0.5 g portions of a commercially available VCI powder were tested in the same way. This reference VCI powder R1) consisted of

| | |
|---|---|
| 28.8 mass % | dicyclohexylamine benzoate |
| 67.1 mass % | cyclohexylamine benzoate |
| 1.5 mass % | 1-H benzotriazole |
| 2.6 mass % | silica gel ($SiO_2$) |

Results of the Test:

The metal test sheets of the 4 different metals used with substance mixture VCI (1) according to the invention all had an unchanged appearance after 35 cycles for all 4 parallel batches.

Of the batches with the commercially available reference system R1 only the metal sheets made of DC 03 were still free from signs of corrosion after 35 cycles. The metal sheets made of Al 99.5 were coated with a yellowish-brown tarnish layer as well as individual white dot-shaped precipitations on both sides, the metal sheets made of Cu ETP each had dark patches commencing at the top and extending down to the black tarnish layer. Most of the metal test sheet batches made of galvanized steel were already marked with initial patchy areas of white rust in their edge areas after just 7 cycles, which became more pronounced during subsequent test cycles.

The commercially available test system R1 is therefore suitable only for the VCI corrosion protection of iron-based materials. The VCI effect of substance combination VCI (1) according to the invention appears very favorable compared to this for common commodity metals from the example described.

Example 2

A coating agent VCI (2) with the following composition was manufactured through introducing water-free components of the substance combination according to the invention, and further substances required as processing excipients into an aqueous polyacrylate dispersion (PLEXTOL BV 411, PolymerLatex):

| | |
|---|---|
| 1.0 mass % | 2,6-dimethoxy-1,4-benzoquinone (DMBQ) |
| 1.0 mass % | benzyl carbamate |
| 1.5 mass % | thymol |
| 2.5 mass % | 2-aminopyrimidine |
| 55.0 mass % | PLEXTOL BV 411 |
| 6.0 mass % | methylethylene ketone |

-continued

| | |
|---|---|
| 16.0 mass % | deionized water |
| 10.0 mass % | sodium benzoate, (micronized, $d_{95} \leq 10$ μm) |
| 6.0 mass % | polymer thickener (Rheovis VP 1231. BASF) |
| 1.0 mass % | de-foaming agent (AGITAN 260/265, MÜNZING Chem.) |

and paper strips (kraft paper 70 g/m$^2$) was coated with a wet application of 15 g/m$^2$. Immediately after drying the VCI paper VCI (2) according to the invention manufactured in this way in air it was tested for its corrosion-protective effect compared to a commercially available corrosion protection paper serving as a reference system (R2).

According to a chemical analysis the commercially available reference system (R2) with a grammage of 66 g/m$^2$ contained the following active substances:

| | |
|---|---|
| 6.2 mass % | triethanolamine caprylate |
| 3.4 mass % | monoethanolamine caprinate |
| 1.4 mass % | benzotriazole |
| 6.7 mass % | sodium benzoate |

Compared to the substance combination according to the invention in preparation VCI (2) the total proportion of active substance components in the reference system (R2) was therefore approximately three times higher.

As with example 1, the comparative test once again used metal test sheets made of DC 03 steel, cold-rolled, low-carbon, material no. 1.0347, d=0.5 mm, aluminum 99.5, d=0.625 mm (both Q-Panel Cleveland), Cu ETP (MKM Mansfelder Kupfer and Messing GmbH), d=0.5 mm and hot-dip galvanized steel (fine grain zinc coating 140 g/m$^2$-70/70 g/m$^2$-10 μm, ArcelorMittal), d=0.8 mm. The test ritual once again equaled that described for Example 1. The only difference here was that individual preserving jars were now lined with VCI paper in place of the VCI powder mixture provided in a Tyvek pouch. This was achieved with 1 circular cut-out each with a diameter of 8 cm at the bottom, a sleeve of 13×28 cm and once again a circular cut-out with a diameter of 9 cm for the lid, always with the coated side facing the insert of metal test sheets to be protected against corrosion. Once the 15 ml deionized water had once again been added and the notched bar had been placed on the bottom together with the 4 metal test sheets the preserving jar was closed and the climate load applied as described in Example 1.

A waiting time of 16 h at room temperature was initially once again stipulated as a so-called development phase for the VCI components inside the closed vessel. This was again followed by the exposure of individual preserving jars in a heat cabinet according to DIN 50011-12 at for 16 h at 40° C., then for 8 h at room temperature. This cyclic load (1 cycle=24 h) was briefly interrupted after every 7 cycles, the preserving jars opened for approx. 2 minutes to replace atmospheric oxygen that may have permutated and to inspect the surface conditions of the metal sheets. After a total of 35 cycles the exposure was terminated and each test piece visually evaluated outside the preserving jars in detail.

Results of the Test:

The various metal test sheets used together with the VCI paper VCI (2) manufactured on the basis of the substance mixture according to the invention all appeared unchanged for all 4 parallel batches after 35 cycles.

Only the metal test sheets made of DC 03 of the batches with the commercially available reference system R2 remained free from visible rust products during the 35 cycles, but were characterized by a more matt appearance compared to their starting condition. The metal test sheets made of Al 99.5 showed a patchy dark tarnish film that could not be wiped off.

The metal test sheets made of galvanized steel displayed initial traces of white rust at their edges after just 7 cycles, which clearly grew larger across the area as the load continued. The appearance of the metal test sheets made of Cu ETP was uneven after 35 cycles. Whilst the appearance of the sheet metal surfaces of 2 batches remained unchanged, parts of the affected sheet metal pieces of the remaining batches were coated with a thin black tarnish layer that could not be wiped off. This finding could not be ruled out during repeated testing.

Reference system R2 is therefore suitable only for the VCI corrosion protection of base iron materials, whilst the active substances emitted from reference system R2 are clearly adsorbed in such different specific concentrations that defects in the VCI corrosion protection effect result with Cu base materials. Compared to this the VCI paper VCI (2) manufactured on the basis of the substance combination according to the invention developed, as the example shows, reliable VCI characteristics even under extreme moist air conditions during long-term use compared to common commodity metals.

Example 3

A corrosion protection oil VCI (3) with the following composition was manufactured through introducing water-free components of the substance combination according to the invention, and further substances required as processing excipients into a commercially available mineral oil:

| | |
|---|---|
| 0.6 mass % | duroquinone |
| 0.1 mass % | benzyl carbamate |
| 0.2 mass % | thymol |
| 0.2 mass % | 4-phenylpyrimidine |
| 92.7 mass % | mineral oil with thixotropy agent normal wax (BANTLEON base oil LV 16-050-2) |
| 6.0 mass % | phenoxyethanol |
| 0.2 mass % | tolyltriazole (TTA, COFERMIN) |

After intensive stirring the VCI oil VCI (3) resulted as an optically clear fluid, characterized by a mean cinematic viscosity of 25±3 mm$^2$/s (20° C.).

A commercially available VCI oil with an approximately identical mean viscosity was tested in the same way as a reference for the VCI oil VCI (3) according to the invention. According to a chemical analysis this reference VCI oil R3, also formulated on the basis of a mineral oil, contained the following active substances:

| | |
|---|---|
| 11.3 g/kg | dicyclohexylamine |
| 8.2 g/kg | diethylaminoethanol |
| 15.1 g/kg | 3.5.5 trimethyl hexanoic acid |
| 3.6 g/kg | benzoic acid. |

As with example 1, the comparative test once again used metal test sheets made of DC 03 steel, cold-rolled, low-carbon, material no. 1.0347, d=0.5 mm, aluminum 99.5, d=0.625 mm (both Q-Panel Cleveland), Cu ETP (MKM Mansfelder Kupfer and Messing GmbH), d=0.5 mm and hot-dip galvanized steel (fine grain zinc coating 140 g/m$^2$-

70/70 g/m$^2$-10 μm, ArcelorMittal), d=0.8 mm. The test ritual once again equaled that described for Example 1.

The major difference now consisted of the notched bars made of PMMA serving as test piece frames now being equipped with 3 pieces each of one and the same test piece type, and the centrally positioned metal test sheet being covered on both sides with the VCI oil to be tested, whilst the metal test sheets each arranged as a distance of approx. 10 mm to the side were not oiled prior to insertion. This allowed the recording of the extent to which the oil film applied to the central metal test sheet is capable of protecting the metal substrate directly covered by the same as well as the two metal test sheets not coated with an oil film against corrosion through emission of the VCI component via the vapor phase inside the closed preserving jar. in practice Each preserving jar (volume 1 l) therefore now contained the notched PMMA bar equipped with the 3 metal test sheets in question, consisting of one and the same material, on the holed floor insert and the 15 ml deionized water dosed under the same. After closing the individual preserving jars the climate load was applied as described in Example 1.

A waiting time of 16 h at room temperature was initially once again stipulated as a so-called development phase for the VCI components inside the closed vessel. This was again followed by the exposure of individual preserving jars in a heat cabinet according to DIN 50011-12 for 16 h at 40° C., then for 8 h at room temperature. This cyclic load (1 cycle=24 h) was once more briefly interrupted after every 7 cycles, the preserving jars opened for approx. 2 minutes to replace atmospheric oxygen that may have permutated and to inspect the surface conditions of the metal sheets. After a total of 35 cycles the exposure was terminated and each test piece visually evaluated outside the preserving jars in detail.

Results of the Test:

The appearance of the different metal test sheets, of which one each was coated with the VCI oil according to the invention, namely VCI (3), together with 2 identical metal test sheets not coated with oil arranged at a distance in a preserving jar, and which were exposed to the cyclic moist air climate, was unchanged for the 3 parallel batches after 35 cycles. The VCI oil VCI (3) according to the invention thus guaranteed good corrosion protection for the metal substrates in question in direct contact as well as for the metal test sheets not covered with the oil inside the closed preserving jar through VCI components emitted via the vapor phase.

Of the batches with the commercially available reference system R3 the metal test sheets made from low-alloy DC 03 steel showed no signs of corrosion either in the oiled or in the non-oiled condition after 35 cycles. However, for the metal test sheets made of Al 99.5, Cu ETP and galvanized steel this was the case only for the oiled condition.

The metal test sheets made from Al 99.5 in a non-oiled condition were consistently coated with a brown tarnish layer after 35 cycles, which was usually more pronounced at the edges of the metal sheets. On the metal test sheets made of Cu ETP used in a non-oiled condition patches with a dark grey to black appearance were observed in the upper edge area after just 7 cycles, which transformed into relatively even tarnish layers that could not be wiped off after 35 cycles.

The most obvious appearance of changes occurred on the non-oiled metal test sheets made of the fine grain galvanized steel. Localized patches of white rust were observed here after just 7 cycles of moist air treatment, preferably in the edge areas, which transformed into patches of a light grey to white appearance as the moist air load continued.

Reference system R3 can therefore be used for the corrosion protection of common commodity metals only in direct contact. The active substances emitted from the same in the gaseous phase are however suitable only for the VCI corrosion protection of iron-based materials. The VCI oil VCI (3) according to the invention however guarantees, as the example shows, pronounced multi-metal protection in that it has proven reliable VCI characteristics in the presence of common commodity metals even under extreme moist air conditions during long-term trials.

What is claimed is:

1. A corrosion-inhibiting substance combination capable of evaporation or sublimation, comprising at least the following components:

(1) 1 to 30 mass % of a substituted 1,4-benzoquinone, (2) 5 to 40 mass % of an aromatic or alicyclic substituted carbamate, (3) 2 to 20 mass % of a polysubstituted phenol, and (4) 0.5 to 10 mass % of a monosubstituted pyrimidine, wherein each mass % relates to a total quantity of the corrosion-inhibiting substance combination.

2. The corrosion-inhibiting substance combination according to claim 1, wherein the substituted 1,4-benzoquinone is selected from the group consisting of tetramethyl-1,4-benzoquinone (duroquinone), trimethyl-1,4-benzoquinone, 2,6-dimethoxy-1,4-benzoquinone (DMBQ), 2,5-dimethoxy-1,4-benzoquinone, 2-methoxy-6-methyl-1,4-benzoquinone, and similarly structured, in particular alkyl- or alkoxy-substituted, substituted 1,4-benzoquinones as well as combinations of the same.

3. The corrosion-inhibiting substance combination according to claim 1, wherein the aromatic or alicyclic substituted carbamate is selected from the group consisting of benzyl carbamate, phenyl carbamate, cyclohexyl carbamate, p-tolyl carbamate and similarly structured substituted carbamates as well as combinations of the same.

4. The corrosion-inhibiting substance combination according to claim 1, wherein the polysubstituted phenol is selected from the group consisting of 5-methyl-2-(1-methylethyl)-phenol (thymol), 2,2'-methylene-bis-(4-methyl-6-tert.-butylphenol), 2-tert.-butyl-4-methylphenol, 2.4.6-tri-tert.-butylphenol, 2.6-dimethoxyphenol (syringol) and similarly structured polysubstituted phenols as well as combinations of the same.

5. The corrosion-inhibiting substance combination according to claim 1, wherein the monosubstituted pyrimidine is selected from the group consisting of 2-aminopyrimidine, 4-aminopyrimidine, 2-methylpyrimidine, 4-methylpyrimidine, 5-methoxypyrimidine, 5-ethoxypyrimidine, 4-phenylpyrimidine, 2-phenoxypyrimidine, 4-(N,N-dimethylamino)pyrimidine and similarly structured monosubstituted pyrimidines as well as combinations of the same.

6. The corrosion-inhibiting substance combination according to claim 1, which is adjusted in such a way that all the components evaporate or sublimate with sufficient quantity and speed for vapor corrosion protection within a temperature range of up to +80° C. at relative humidity (RH) of ≤98%.

7. The corrosion-inhibiting substance combination according to claim 1, which further comprises additional vapor phase corrosion inhibitors other than components (1) to (4), either individually or as a mixture with components (1) to (4).

8. A VCI corrosion protection oil, comprising a mineral oil or synthetic oil and a corrosion-inhibiting substance combination according to claim 1 optionally in a solubilizer, wherein all the components evaporate or sublimate with sufficient quantity and speed for vapor corrosion protection within a temperature range of up to +80° C. at a relative humidity (RH) of ≤98%.

9. A method for manufacturing a corrosion-inhibiting substance combination capable of evaporating or sublimating, wherein at least the following components are mixed with each other to provide the corrosion-inhibiting substance combination:

(1) 1 to 30 mass % of a substituted 1,4-benzoquinone, (2) 5 to 40 mass % of an aromatic or alicyclic substituted carbamate, (3) 2 to 20 mass % of a polysubstituted phenol, and (4) 0.5 to 10 mass % of a monosubstituted pyrimidine.

10. A method of inhibiting corrosion comprising providing the corrosion-inhibiting substance combination according to claim 1 as a volatile corrosion inhibitor (VpCI, VCI) in a form of fine powder mixtures or briquettes (pellets) manufactured from the same during packaging, storage or transport of metal materials.

11. A method of inhibiting corrosion comprising incorporating the corrosion-inhibiting substance combination according to claim 1 into coating materials or coating solutions, for coating carrier materials selected from the group consisting of paper, cardboard, foam and textile fabric.

12. A method of manufacturing a corrosion protection oil, said method comprising providing the corrosion-inhibiting substance combination according to claim 1 in a form of a corrosion protection oil from which vapor phase corrosion inhibitors (VpCI, VCI) are emitted.

13. A method of inhibiting corrosion comprising providing the corrosion-inhibiting substance combination according to claim 1 to protect a metal from corrosion during packaging, storage and transport processes.

14. The method according to claim 13, wherein the metal is a member selected from the group consisting of iron, chrome, nickel, aluminum, copper, alloys thereof and galvanized steel.

* * * * *